United States Patent [19]

Salukvadze

[11] 4,172,682

[45] Oct. 30, 1979

[54] ROTARY CUTTING TOOL FOR MACHINING THE SURFACES OF VARIOUS WORKPIECES AND MATERIALS

[76] Inventor: Viktor S. Salukvadze, 5 Parkovaya ulitsa, 42, kv. 53, Moscow, U.S.S.R.

[21] Appl. No.: 909,055

[22] Filed: May 24, 1978

[51] Int. Cl.[2] ..... B26D 1/12; B08B 9/00

[52] U.S. Cl. ..... 407/31; 407/51; 15/104.04

[58] Field of Search ..... 407/31, 33, 34, 51; 15/104.04

[56] References Cited

U.S. PATENT DOCUMENTS

| | | | |
|---|---|---|---|
| 3,527,611 | 9/1970 | Newfarmer | 15/104.04 |
| 3,820,184 | 6/1974 | Stone | 15/104.04 |
| 3,928,900 | 12/1975 | Salukvadze et al. | 407/51 |
| 4,070,130 | 1/1978 | Salukvadze | 407/31 |

*Primary Examiner*—Leonidas Vlachos
*Attorney, Agent, or Firm*—Haseltine, Lake & Waters

[57] ABSTRACT

The present invention relates to rotary cutting tools and can find most utility when applied for abrading the cylindrical surfaces of small-sized blanks. The tool comprises a number of the gangs of elastic cutting elements made as equal-length wire segments held together with one of their ends in a close proximity to which said cutting elements are forced to one another with their side surface, while the other (vacant) ends of the cutting elements establish the tool cutting surface featuring a factor of its filling with the butt ends of the cutting elements lying within 0.1 and 0.99. Each of the gangs of cutting elements (as viewed in a longitudinal section thereof) is essentially two opposite trapezia spaced equidistantly from the tool axis of rotation and facing with their greater bases said axis, a feature that adds much to the cutting capacity of the herein-proposed tool.

2 Claims, 2 Drawing Figures

ROTARY CUTTING TOOL FOR MACHINING THE SURFACES OF VARIOUS WORKPIECES AND MATERIALS

FIELD OF THE INVENTION

The present invention relates generally to cutting tools and more specifically to rotary cutting tools for machining the surfaces of cylindrical workpieces.

The invention can find most utility when used for abrading the cylindrical surfaces of small-diameter blanks, such as wire rods subject to further treatment in wire drawing machines.

BACKGROUND OF THE INVENTION

It is known to extensively use at present diverse methods of and tools for cleaning the cylindrical surfaces of various metal and nonmetal workpieces, said methods being as follows:

(1) dip-scouring;
(2) treatment with abrasive wheels and belts;
(3) treatment in special snagging machines;
(4) treatment with rotary metal brushes;
(5) needle-milling.

Most commonly applicable in the present-day cleaning practice is the continuous dipping method and stationary-bath dipping of cylindrical surfaces of various workpieces and materials.

However, the disadvantages inherent in chemical dipping process is a matter of common knowledge, i.e., it causes environmental contamination, produces harmful effect upon attending personnel and involves much capital investments and operating costs.

Cylindrical surfaces of various workpieces and materials are also known to be cleaned with abrasives in special stationary machines.

However, abrasive wheels and belts feature but low endurance, while if used for treating tough or ductile materials, they are liable to get smeared and form burnt spots on the surface being machined.

Furthermore, abrasive cleaning of cylindrical surfaces is a labourious and costly process which badly affects automation owing to low endurance of the abrasive tools used.

Abrasive cleaning is incapable of efficiently machining tough nonferrous materials, such as aluminium, copper, etc.

In addition, abrasive tools lade the surrounding atmosphere with abrasive dust in the course of machining.

Cleaning of cylindrical surfaces of workpieces and materials can also be carried out in special snagging grinders.

However, such machines are capable of removing only surface flaws for a minimum depth of 0.5 mm, thus being not suitable for cleaning off thin scale.

One of the cardinal disadvantages of said method resides in heavy losses of metal and great consumption of snagging tools.

Used in the present-day practice is the cleaning of cylindrical surfaces of metal surfaces with the use of rotary brushes having inside cutting surface (cf., e.g., U.S. Pat. No. 3,820,184 Cl. 15/104.04).

Said brushes contain each a number of gangs of radially arranged "bristles" held together with their one end and forming the tool working surface, with their other end, said "bristles" being held together in a gang along the outside perimeter thereof to form a ring in a cross section of the tool.

However, the known brushes fail to cut off scale from the blank surfaces or form cross notches on the surface being machined for retaining grease during further machining in drawing benches, being suitable only for partial removal of outside loosened layer of rust and dirt.

There is finding ever extending application at present one more method of cleaning cylindrical surfaces with the use of a cutting tool, i.e., needle-type milling cutter. This is accounted for by the fact that such tools possess high cutting capacity and are convenient and simple in operation.

There pertains to such tools a rotary cutting tool, comprising a number of elastic cutting elements arranged radially on an arbor and made as equal-length wire segments held together with their one ends in a close proximity to which said cutting elements are forced against one another with their side surface, whereas the opposite vacant ends thereof establish the tool cutting surface shaped as a surface of revolution, the ratio between the sum of the face areas of the vacant ends of the wire segments on the tool cutting surface and the total area of the tool cutting surface being within 0.10 to 0.99 (cf. e.g., U.S. Pat. No. 3,928,900). Said tool features its cutting elements aggregated into gangs interlaid by spacer rings within the zone of their ends held together, so that the curvature of the cutting surface in the tool cross section follows substantially the curvature of the surface being machined.

However, said known tool is applicable largely for cleaning the surface of rolled stock and peeling cast workpieces, has a restricted use in cleaning small-diameter cylindrical surfaces and is quite inapplicable for treating wire rods. This is explained by the fact that such a treatment produces longitudinal grooves or notches on the surface thereof rather than transverse ones, the former being incapable of retaining grease on the wire rod surface which is indispensable for further treatment of wire rods in wire drawing machines.

OBJECT AND SUMMARY OF THE INVENTION

It is an object of the present invention to provide a rotary cutting tool, wherein its cutting capacity would be much increased due to an improved construction of a gang of cutting elements thereof.

It is an important object of the present invention to provide a rotary cutting tool featuring higher efficiency.

Said and other objects are accomplished due to the fact that in a rotary cutting tool for machining the surfaces of various workpieces and materials, comprising a number of gangs of radially arranged elastic cutting elements shaped as equal-length wire segments held together with one of their ends in a close proximity to which said cutting elements are forced against one another with their side surfaces, while the opposite vacant ends of said wire segments define the tool cutting surface having a factor of its filling with the ends of cutting elements ranging between 0.1 and 0.99, the cutting elements in each gang being held together along the outside perimeter thereof to form a ring in the tool cross section, according to the invention each of the gangs of cutting elements, as viewed in a longitudinal section thereof, is essentially two opposite trapezia space equidistantly from the tool axis of rotation and facing with their greater bases said axis, while the ratio between the greater and the lesser bases of said trapezium is determined by the following relation:

$$\frac{B}{B_1} = \frac{1}{\phi_o}\left(1 + \frac{2l}{D}\right)$$

where

B denotes the width of the tool cutting surface;

$B_1$ stands for the width of the surface established by the ends of the tool cutting elements held together;

$\phi_o = \phi_1/\phi$ is the ratio between the density of arrangement of the ends of cutting elements on the surface defined by their ends held together, and the density of arrangement of the ends of cutting elements on the tool cutting surface;

l indicates the length of cutting elements;

D means the diameter of the tool cutting surface, whereas the adjacent groups of the gangs of cutting elements are offset with respect to each other for a distance $C = D - D_o + 2\Delta$, where D stands for the diameter of the tool cutting surface;

$D_o$ denotes the diameter of the surface being treated;

$\Delta$ is the amount of interference of the tool with the surface being treated (to be determined technologically).

It is due to such a constructional arrangement of the proposed tool that the contact of the tool cutting surface with the surface being treated occurs over an area which makes it possible to considerably increase tool cutting capacity and diminish the number of tools required for the entire blank perimeter to cover.

In addition, the above-suggested ratio between the width of the tool cutting surface and the surface of the wire ends held together makes provision for an angular position of the vacant peripheral ends of cutting elements with the surface being machined which is instrumental in providing a positive cutting angle $\alpha$ with respect to the direction of axial travel of the workpiece being treated and obtaining an exactly preset factor of its filling with the butts of the vacant ends of cutting elements lying within 0.1 to 0.99, thereby adding to the tool cutting capacity.

BRIEF DESCRIPTION OF THE DRAWINGS

To promote understanding, a detailed description of an exemplary embodiment of the present invention is set forth hereinbelow with reference to the accompanying drawings, wherein.

DETAILED DESCRIPTION OF THE INVENTION

Figure 1:
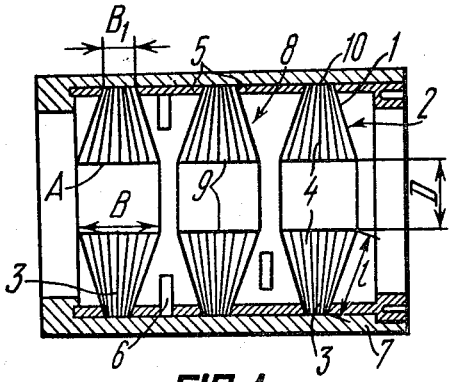
FIG. 1 is a schematic view of the proposed cutting tool composed of a number of the gangs of cutting elements.

The herein-proposed rotary cutting tool for machining predominantly cylindrical workpieces (FIG. 1) comprises a number of gangs 1 of elastic cutting elements 2 made as, say, equal-length wire segments held together with one of their ends 3. In a close proximity to said ends 3 held together the cutting elements 2 are forced against one another with their side surfaces, while their opposite vacant ends 4 define the tool cutting surface A featuring a preset factor of its filling with the butt ends of the cutting elements lying within 0.1 and 0.99.

Provided in between the side surfaces of the gangs 1 on the side of the held-together ends 3 of the cutting elements 2 are spacer rings 5 having annular recesses 6. The gangs 1 of the elastic cutting elements 2 along with the spacer rings 5 are enclosed in an eccentric bush 7. The cutting elements 2 may be made of round, square or rectangular-section wire, as well as be shaped as plates reinforced with cemented carbide or abrasive material. Each of the gangs 1 of the cutting elements 2 is shaped as a ring whose longitudinal section is essentially two trapezia 8 spaced equidistantly from the tool axis of rotation and facing said axis with their greater bases 9. In addition, the ratio between the greater base 9 of the trapezium 8 and a lesser base 10 thereof is determined from the following relation:

$$\frac{B}{B_1} = \frac{1}{\phi_o}\left(1 + \frac{2l}{D}\right) \quad \text{(I)}$$

where

B denotes the width of the cutting surface A;

$B_1$ stands for the width of the surface established by the held-together ends 3 of the cutting elements 2;

$\phi_o = \phi_1/\phi$ is the ratio between the density of arrangement of the butt ends of the cutting elements 2 on the surface formed by their ends 3 held together, and the density of arrangement of the butt ends of the cutting elements 2 on the tool cutting surface A;

l indicates the length of cutting elements;

D means the diameter of the tool cutting surface A.

Figure 2:
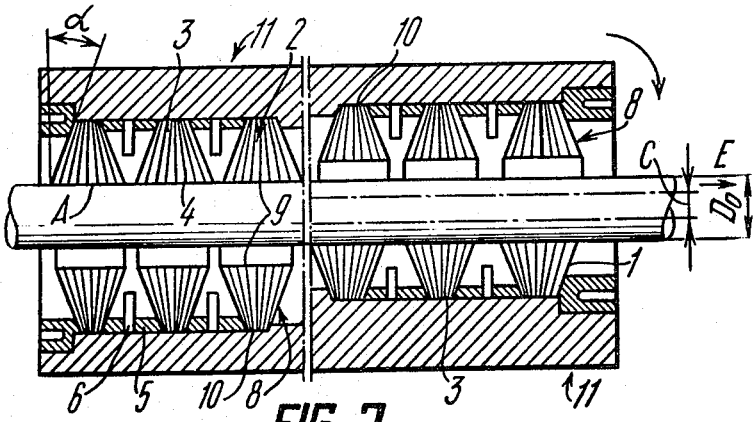
FIG. 2 shows the cutting tool of FIG. 1, wherein a number of the gangs of cutting elements are aggregated into groups.

The proposed tool (FIG. 2) may be composed of a number of the gangs 1 of the cutting elements 2 assembled into groups II, so that the adjacent groups II of the gangs 1 are offset with respect to each other by a quantity C which is determined from the following relation:

$$C = D - D_o + 2\Delta \quad \text{(II)}$$

where

D stands for the diameter of the tool cutting surface A;

$D_o$ denotes the diameter of the surface being treated;

$\Delta$ means the amount of the tool interference with the surface being treated (to be found technologically).

Such a construction of the tool enables one to simplify the gear trains of the machine, as the blank is machined by virtue of the stock travelling towards the arrow E and of the tool rotation substantially round its own axis, whereas tool rotation round the blank is negligible, mostly for changing the place of contact of the cutting surface A with the surface being machined.

The proposed constructional arrangement of the cutting tool and the ratio between the width of the tool cutting surface and the width of its surface at the held-together ends make it possible to effect the contact between the cutting surface and the surface being treated substantially over an area, and to obtain an exactly preset arrangement density of the vacant ends of cutting elements which as a whole adds much to the tool cutting capacity and enables one to reduce the number of tools required for the entire blank perimeter to cover.

Disclosed hereinbelow are some examples of practical embodiment of the tool discussed hereinbefore.

EXAMPLE 1

Let a rotary cutting tool for peeling wire rod stock must be provided, the inside diameter D of the tool cutting surface A being equal to 30 mm. Proceeding from the tool cutting efficiency the width B of its cutting surface A equals 30 mm. The factor $\phi$ of density of arrangement of the butt ends of cutting elements on the cutting surface A is equal to 0.8. Proceeding from a preset tool endurance equal to 500 operating hours let us assume the length l of the cutting elements equal to 25 mm. Inasmuch as a maximum possible factor $\phi$ of density of arrangement of the butt ends of cutting elements on the surface established by their ends held together, in case the cutting elements are made as round-wire segments, is equal to 0.906, and a practically attainable density $\phi_1$ (after applying a pressing force not below 20 kgf/cm$^2$) is equal to 0.88 or 0.9, we assume $\phi_1$ to be equal to 0.9. Then find that $$1/\phi_o=\phi/\phi_1=0.8/0.9=0.89. \quad \text{(III)}$$

Then, taking into account that, according to the invention $$\frac{B}{B_1}=\frac{1}{\phi_o}\left(1+\frac{2l}{D}\right) \quad \text{(I)}$$

we find that $$B_1=\frac{B}{\frac{1}{\phi_o}\left(1+\frac{2l}{D}\right)} \quad \text{(IV)}$$

Having substituted all the afore-stated magnitudes of the respective quantities to Equation IV, we shall obtain:

$$B_1=\frac{30}{0.89\left(1+\frac{2.25}{30}\right)}=12.7 \text{ mm}$$

Inasmuch the surface of a gang of cutting elements, as viewed from the held-together ends thereof, assumes somewhat convexity after having been exposed to pressing, the numerical value of $B_1$ lies within 11.5 and 12 mm.

EXAMPLE 2

The rotary cutting tool made according to Example 1, is used in groups of the gangs of cutting elements for treating wire rod stock featuring $D_o=10$ mm. In this case the amount by which one of the groups of the gangs of cutting elements is offset with respect to the other groups is equal to:

$$C=D-D_o+2\Delta \quad \text{(V)}$$

or $$C=30-10+20.5=21 \text{ mm.}$$

What is claimed is:

1. A rotary cutting tool for machining the surface of various workpieces and materials, comprising: an arbor; a number of gangs of elastic cutting elements shaped as equal-length wire segments arranged radially on said arbor; said elastic cutting elements held together with one of their ends along the outside perimeter thereof to form a ring in the tool cross section, and forced against one another with their side surface in a close proximity to said held-together ends; vacant ends of said elastic cutting elements opposite to those held together, establishing the tool cutting surface featuring a factor of its filling with the butts of said elastic cutting elements lying within 0.1 and 0.99; each of said gangs of said elastic cutting elements, as viewed in a longitudinal section thereof, being essentially two opposite trapezia spaced equidistantly from the tool axis of rotation and facing said axis with the greater bases thereof; the ratio between the greater trapezium base and the lesser base thereof being determined from the following relation:

$$\frac{B}{B_1}=\frac{1}{\phi_o}\left(1+\frac{2l}{D}\right)$$

where

B denotes the width of the tool cutting surface;

$B_1$ stands for the width of the surface established by the ends of the tool cutting elements held together;

$\phi_o=\phi_1/\phi$ is the ratio between the closeness of arrangement of the ends of cutting elements on the surface established by their ends held together, and the density of arrangement of the ends of cutting elements on the tool cutting surface A;

l indicates the length of cutting elements;

D means the diameter of the tool cutting surface A.

2. A tool as claimed in claim 1, wherein the adjacent groups of the gangs of cutting elements are offset with respect to each other for a distance found from the following equation:

$$C=D-D_o+2\Delta$$

where

D stands for the diameter of the tool cutting surface;

$D_o$ denotes the diameter of the surface being treated;

$\Delta$ means the amount of the tool interference with the surface being treated.

* * * * *